United States Patent [19]

Adam et al.

[11] 4,378,446

[45] Mar. 29, 1983

[54] ACRYLATE-MODIFIED MELAMINE RESIN WHICH IS STABLE ON STORAGE, ITS PREPARATION AND ITS USE

[75] Inventors: Wilhelm Adam, Neu-Isenburg; Curt A. Wagner, Frankfurt am Main; Renate Konrad, Frankfurt am Main; Friedrich Engelhardt, Frankfurt am Main; Ulrich Riegel, Frankfurt am Main; Georg W. Eckhardt, Frankfurt am Main; Steffen Piesch, Oberursel, all of Fed. Rep. of Germany

[73] Assignee: Cassella Aktiengesellschaft, Frankfurt, Fed. Rep. of Germany

[21] Appl. No.: 266,486

[22] Filed: May 22, 1981

Related U.S. Application Data

[63] Continuation-in-part of Ser. No. 185,165, Sep. 8, 1980, abandoned.

[30] Foreign Application Priority Data

Sep. 10, 1979 [DE] Fed. Rep. of Germany ..... 2936518

[51] Int. Cl.[3] ..... C08L 61/28; C08L 61/32

[52] U.S. Cl. ..... 524/512; 427/408; 427/415; 428/511; 428/514; 428/530; 524/247

[58] Field of Search ..... 260/29.4 UA, 29.6 NR; 525/162; 528/254; 428/514, 530, 511; 524/512; 427/408

[56] References Cited

U.S. PATENT DOCUMENTS

| | | | |
|---|---|---|---|
| 3,245,932 | 4/1966 | Glavis et al. | 260/29.4 UA |
| 3,976,614 | 8/1976 | Elms | 260/29.4 UA |
| 3,983,307 | 9/1976 | Power et al. | 428/530 |
| 4,038,229 | 7/1977 | Eisele et al. | 528/254 |
| 4,076,896 | 2/1978 | Bunkowski | 528/254 |

*Primary Examiner*—Theodore E. Pertilla
*Attorney, Agent, or Firm*—Connolly and Hutz

[57] ABSTRACT

Low viscosity, aqueous impregnating resin solution with improved stability containing 30–70% by weight of solid resin which comprises:

(A) 80–98% by weight of a melamine-formaldehyde precondensate and (B) 2–20% by weight of a water soluble copolymer.

8 Claims, No Drawings

ACRYLATE-MODIFIED MELAMINE RESIN WHICH IS STABLE ON STORAGE, ITS PREPARATION AND ITS USE

This is a continuation-in-part of our copending application Ser. No. 185,165, filed Sept. 8, 1980, now abandoned.

The invention relates to an aqueous solution of impregnating resin which is based on a mixture of melamine resin and a water-soluble acrylate polymer and has excellent storage properties and is used for the production of laminates and coated wood materials having surfaces of excellent resistance to weathering.

Solutions of impregnating resins based on melamine resin are required in the production of decorative laminated sheets and in the surface finishing of wood materials, such as, for example, chipboards and moulded fibre boards, for impregnating webs of paper or fabric which form the decorative or protective surface in the finished laminated sheets or wood materials.

In the production of the decorative laminated sheets and in the surface finishing of wood materials, the webs of fabric or paper are impregnated to a specific resin content in the aqueous solutions of impregnating resins and are dried to a specific residual moisture content at temperatures of 120°–160° C. The webs of fabric or paper thus treated are pressed onto wood materials or onto a stack of resin-impregnated paper sheets, moulding pressures of 8 to 120 bars and temperatures of 100°–165° C. being applied.

This method gives decorative laminated sheets and coated wood materials which are employed chiefly in interior work for the production of furniture, lining walls and ceilings and the sanitary sector, to mention only a few fields of application. These laminates are not suitable for use in the open, for example for external walls or pre-fabricated houses, since considerable losses of gloss and attacks on the surface occur within 3–5 years.

Melamine resins are prepared by subjecting formaldehyde to a condensation reaction with melamine, the reaction being taken only to a point at which the reaction products still remain soluble and fusible. When this condition has been reached, the condensation reaction is discontinued, which can be effected, for example, by cooling and adjusting the pH to a slightly alkaline value. This gives products which are not fully condensed and which are termed melamine resin precondensates and are used as impregnating resins in the form of their aqueous solutions. The impregnating resin can also be partly etherified with lower alcohols or modified by means of modifying agents, such as sugar, polyhydric alcohols, carboxamides and sulphonamides, and can also be catalysed with inorganic or organic salts which have an acid reaction. It is important, above all, in coating wood materials, that the melamine resins employed are rendered elastic by means of elasticising agents, in order to prevent subsequent formation of cracks in the coated surface.

If webs of fabric or paper which have been impregnated with impregnating resin and dried are compression moulded to give laminates, curing takes place as a result of crosslinking throughout the condensate.

The addition to the aminoplast impregnating resins of aqueous polymer dispersions and substances containing hydroxyl groups and also inorganic compounds with a layer lattice structure is known (German Offenlegungsschrift No. 144,156). However, these products exhibit the known disadvantages of aqueous dispersions, such as a tendency to settle, sensitivity to frost, poor impregnating power and disadvantageous effect of the emulsifiers present in the dispersions on the resistance to water of the materials produced.

The addition of thickeners to melamine resins is also known (German Auslegeschrift No. 1,137,303). However, this process is carried out at a relatively high viscosity, which causes considerable difficulty to the thorough impregnation required.

A further process (German Offenlegungsschrift No. 2,146,101) describes the production of adhesion-promoting layers using aminoplast resins containing 25–75% of a water-soluble polymer.

Impregnating resins are also known from German Offenlegungsschrift No. 2,460,994, which consist of a mixture of melamine resin and a water-soluble polymer and are used for the production of weather-resistant surfaces. However, these products have relatively poor storage properties, which naturally makes processing difficult and, for example, makes it impossible to despatch ready-to-use products over fairly large distances. It has now been found, surprisingly, that low-viscosity, aqueous impregnating resin solutions containing 30 to 70% by weight of solid resin consisting, to the extent of 80–98% by weight, of a melamine-formaldehyde precondensate which has optionally been modified with known modifying agents and in which the molar ratio of melamine:formaldehyde is 1:1.4 to 1:2.6, preferably 1:1.5 to 1:2.3, and which contains 0.2 to 1.0% by weight, preferably 0.25 to 0.5% by weight, relative to solids content, of an amine of the formula I

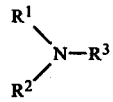

(I)

wherein $R^1$ and $R^2$ denote identical or different alkyl radicals having 1 to 4 C atoms and $R^3$ denotes 2-hydroxyethyl, 2-(2-hydroxyethoxy)-ethyl, 3-hydroxy-1-propyl, 3-hydroxyl-2-propyl, 2,3-dihydroxypropyl or a radical of the formula $$-CH_2CH_2-NR^1R^2$$

it being possible for this amine to be present wholly or partly in the form of its reaction products with the melamine-formaldehyde condensation product, and optionally contains 0.5 to 40% by weight, relative to solids content, of a modifying agent based on lower, saturated fatty acid amides, and consisting, to the extent of 2–20% by weight, of a water-soluble copolymer formed from (a) 0–55% by weight of an ester of acrylic acid, methacrylic acid, crotonic acid, maleic acid or itaconic acid and an alcohol having 1 to 4 C atoms and/or acrylonitrile and/or methacrylonitrile or a mixture of these compounds, (b) 25–100% by weight of a hydroxyethyl or hydroxypropyl ester of acrylic acid, methacrylic acid, crotonic acid, maleic acid or itaconic acid and/or the reaction product of these acids with glycidol or a mixture of these compounds, and (c) 0–25% by weight of acrylic acid, methacrylic acid, maleic acid, itaconic acid or crotonic acid and/or acrylamide, methacrylamide, crotonamide, maleic acid half-amide or a mixture of these compounds, do not exhibit the disadvantages of the products known hitherto, are distinguished, in particular, by outstanding stability on storage and, if used in accordance with the instructions, provide surfaces with an excellent resistance to weathering.

The esters, mentioned under (a), of the acids listed can contain, as the alcoholic component, methanol, ethanol, n-propanol, i-propanol, n-butanol, i-butanol and tert.-butanol.

Impregnating resin solutions according to the invention are prepared by mixing into a melamine-formaldehyde precondensate which has optionally been modified with known modifying agents and in which the molar ratio of melamine:formaldehyde is 1:1.4 to 1:2.6, preferably 1:1.5 to 1:2.3, and which contains 0.2 to 1.0% by weight, preferably 0.25 to 0.5% by weight, relative to solids content, of an amine of the formula I

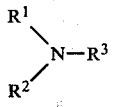

(I)

wherein $R^1$ and $R^2$ denote identical or different alkyl radicals having 1 to 4 C atoms and $R^3$ denotes 2-hydroxyethyl, 2-(2-hydroxyethoxy)-ethyl, 3-hydroxy-1-propyl, 3-hydroxy-2-propyl, 2,3-dihydroxypropyl or a radical of the formula $$-CH_2CH_2-NR^1R^2$$

it being possible for this amine to be present wholly or partly in the form of its reaction products with the melamine-formaldehyde condensation product, and optionally contains 0.5 to 40% by weight, relative to solids content, of a modifying agent based on lower, saturated fatty acid amides, 1–20% by weight of a water-soluble copolymer formed from (a) 0–55% by weight of an ester of acrylic acid, methacrylic acid, crotonic acid, maleic acid or itaconic acid and an alcohol having 1 to 4 C atoms and/or acrylonitrile and/or methacrylonitrile or a mixture of these compounds, (b) 25–100% by weight of a hydroxyethyl or hydroxypropyl ester of acrylic acid, methacrylic acid, crotonic acid, maleic acid or itaconic acid and/or the reaction product of these acids with glycidol or a mixture of these compounds, and (c) 0–25% by weight of acrylic acid, methacrylic acid, maleic acid, itaconic acid or crotonic acid and/or acrylamide, methacrylamide, crotonamide, maleic acid half-amide or a mixture of these compounds.

The polymer is appropriately mixed in in the form of a solution, especially in the form of a solution such as is produced in the preparation of the polymer.

It is subsequently possible also to add, to the resin solutions according to the invention, known curing agents or curing accelerators, for example salts of weak to strong organic acids, for example diethanolamine acetate, ethanolamine hydrochloride, ethylenediamine acetate, ammonium thiocyanate, ammonium lactate, ethylenediamine phosphate or morpholine p-toluenesulfonate, in order to accelerate the curing reaction.

By virtue of the outstanding stability on storage of the resins according to the invention in the presence of known curing agents, it is also even possible to add a curing agent to the resins, in a quantity sufficient to cause curing, before the resins are despatched.

Melamine-formaldehyde precondensates which are preferred for the preparation of the acrylate-modified resin solutions according to the invention are those containing an amine of the formula I in which $R^1$ and $R^2$ are methyl groups, or in which $R^3$ is 2-hydroxyethyl or 2,3-dihydroxypropyl. Precondensates which are particularly preferred are those in which preferred elements are combined, such as, for example, those which contain, as the amine of the formula I, dimethylethanolamine or 1-(dimethylamino)-2,3-dihydroxypropane. A further preferred group of melamine-formaldehyde precondensates is formed by those which contain 0.5 to 40% by weight, relative to solids content, preferably 2.5 to 25% by weight, of modifying agent based on lower, saturated fatty acid amides. Examples of known modifying agents of this type are methylenebisformamide of the formula II

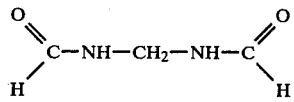

(II)

which is known from German Offenlegungsschrift No. 2,149,970 and bis-(N-acylaminomethyl) ether of the formula III

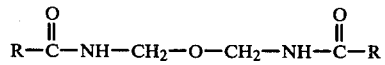

(III)

wherein R denotes hydrogen or methyl, which is known from German Offenlegungsschrift No. 2,558,148.

Further very suitable modifying agents based on lower, saturated fatty acid amides are the condensation products formed from ε-caprolactam, formaldehyde and formamide in a molar ratio of 1:a:b, wherein a denotes a number from 1 to 20, preferably 1 to 2, and b denotes a number from 1 to 19, preferably 1, and a and b are so chosen that the quotient $a/(b+1)=0.5$ to 1.

In this connection, special mention should be made, amongst the condensation products, of N-(formylaminomethyl)-ε-caprolactam and of N-(N'-formyl-N'-hydroxymethylaminomethyl)-ε-caprolactam.

The melamine-formaldehyde precondensates required for the preparation of the resin solutions according to the invention are prepared by subjecting melamine, formaldehyde and, if appropriate, modifying agents which are in themselves known, to a condensation reaction in a manner which is in itself known in the presence of customary inorganic bases in the pH range between 8.2 and 10.4, until a dilutability ratio with water of about 1:3.0 to 1:0.8 has been reached. Before, during or after the condensation reaction, 0.2 to 1.0% by weight, relative to solids content, of an amine of the formula I wherein the radicals $R^1$, $R^2$ and $R^3$ have the definition indicated above, are added to the resin batch. A number of modifying agents which are in themselves known can also be added in a desired quantity to the condensation reaction batch after the condensation reaction. The pH value of 8.2 to 10.4, which is necessary for carrying out the condensation reaction, is customarily adjusted by adding known inorganic bases, such as alkali metal hydroxides, for example sodium hydroxide or potassium hydroxide, or alkali metal carbonates, for example sodium carbonate or potassium carbonate.

If the amine of the formula I is added after the condensation reaction, which has been carried out using inorganic bases in a manner which is in itself known, this results in the finished resin having a total content of bases, of inorganic base and amine of the formula I, which is slightly higher than the quantities of base customarily present. As a rule, this slight excess of bases does not have a disadvantageous effect in any way. If it is desired to be absolutely certain that no reduction at all in the degree of curing will occur, it is possible to meter in a little more curing agent or to make the compression moulding conditions a little more drastic. It is also possible, but not necessary, to compensate for the slight excess of bases in the finished resin by introducing, into the resin after the condensation reaction, a fraction, equivalent to the alkali present in the condensation reaction, of the amine of the formula I in the form of its salt with a strong inorganic acid, such as, for example, in the form of the sulphate or the hydrochoride, and only adding, in the form of the free base, the fraction of the amine of the formula I which exceeds this quantity. The preparation of the products according to the invention is carried out most simply if the amine of the formula I is already added to the reaction batch before the start of the condensation reaction. In this case, the adjustment of the pH value required for the condensation reaction can be effected solely by means of this amine and the addition of inorganic bases which are in themselves known can be omitted. It is therefore preferable, in preparing the resins according to the invention, to add the amine before the start of the condensation reaction.

In the preparation of the resin, condensation reaction is, as usual, only carried out to a point where the resins still remain soluble and fusible. In so doing, the condensation reaction is, as a rule, carried out up to a limited dilutability ratio with water—in the preparation of the resins according to the invention, as a rule up to a dilutability ratio with water of about 1:3.0 to 1:0.8. In some cases, for example if major amounts of salts of aminosulphonic acid are added, the resulting resins can also be soluble in water without limit. The dilutability ratio with water is determined by titrating a sample of the resin with water at 20° C. For example, the statement "dilutability ratio with water 1:X" means that a ml of resin can take up X ml of water at 20° C. without cloudiness being formed. The performance of the condensation reaction in the preparation of aminoplasts is described in detail, for example, in Kirk-Othmer, Encyclopedia of Chemical Technology, 1st edition, volume 1 (1947), 756–759; Houben-Weyl "Methoden der organischen Chemie" (Methods of Organic Chemistry"), volume XIV/2; "Makromolekulare Stoffe" (Macromolecular Materials"), part 2, (1963), Georg Thieme Verlag Stuttgart, in particular pages 346 to 357 (urea condensation product), pages 357–371 (melamine condensation products) and pages 382–388 (condensation products of dicyandiamide and guanidine); John F. Blais "Amino Resins", Reinhold Publishing Corp., New York (1959), pages 26–53; C. P. Vale "Aminoplastics", Cleaver Hume Press Ltd., London (1950), pages 12–87 and Ullmanns Encyklopädie der technischen Chemie (Ullmann's Encyclopedia of Industrial Chemistry), 4th edition, volume 7 (1973), pages 403 to 414. When preparing the resins, it is additionally possible also to add other known modifying agents, for example water-soluble mono-alcohols or di-alcohols, such as methanol, ethanol, ethylene glycol or ethylene diglycol, and also pentaerythritol, carbamates, such as methyl carbamate or methoxyethyl carbamate, salts of maleic acid or fumaramic acid, sugars, sorbitol, amidosulphonic acid, aromatic sulphonamides or salts.

The preparation of the condensation product formed from ε-caprolactam, formaldehyde and formamide, which can be employed as a modifying agent, can be effected, for example, in accordance with the instructions of German Offenlegungsschrift No. 2,755,588.

The water-soluble copolymer employed for the preparation of the resin solution according to the invention is obtained by copolymerising the compounds mentioned under (a), (b) and (c). In each of the groups (a), (b) or (c) it is possible for a mixture of two or more compounds to be present, for example in group (c) a mixture consisting of acrylamide and acrylic acid.

The copolymerisation is carried out in a manner which is in itself known, at temperatures between 20° and 130° C., preferably between 50° and 90° C. Suitable polymerisation media are water and water-miscible organic solvents, such as, for example, methanol, ethanol, isopropanol, acetone, dioxan, dimethylformamide, tetrahydrofuran and the like, and also mixtures of water-miscible solvents with one another and/or with water. The copolymerisation should be carried out in such a way that the viscosity of the resulting solution of the water-soluble polymer is 100–10,000 cP, preferably 100–2,000 cP, since products of higher viscosity are not so readily miscible with the melamine resin, and this is achieved by adding regulators such as carbon tetrachloride, isooctyl thioglycollate, thioglycerol, n-butylmercaptan and others and/or a mixture of these compounds, to the polymerisation solution.

In order to ensure compatibility with the melamine resin, the finished polymer solution must be adjusted to a slightly basic pH value of 7.1 to 8.5, for example, 7.5 to 8.0, exclusively by means of organic amines of the general formula

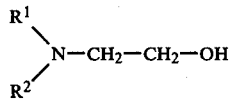

wherein $R^1$ and $R^2$ have the meanings indicated above, preferably dimethylaminoethanol.

Water-soluble polymers which are preferred are those which are obtained by copolymerising 0–55% by weight of the compounds mentioned under a, 25–80% by weight of the compounds mentioned under b and 2–25% by weight of the compounds mentioned under c.

The low-viscosity, aqueous impregnating resin solutions according to the invention, which are stable on storage, are outstandingly suitable for the impregnation of absorbent carrier webs, such as paper, fleece or fabric, for top layers in the production of laminates. Laminates are understood here to mean especially decorative laminated plastic panels according to DIN 16,926, plastic-coated decorative moulded fibre boards according to DIN 68,751 and plastic-coated decorative flat pressed particle boards according to DIN 68,765 and also other wood materials with a decorative coating, such as chipboards with a decorative coating. The production of such laminates is described, for example, in John F. Blais "Amino Resins", Reinhold Publishing Corp., New York (1959), 122–138; C. P. VALE "Aminoplastics"Cleaver-Hume Press LTD London, (1950), 209–214 and Ullmanns Encyklopädie der technischen Chemie (Ullmann's Encyclopedia of Industrial Chemistry), 4th edition, volume 7 (1974), 417–418.

It was surprising that it is possible to produce low viscosity, aqueous impregnating resins which are stable on storage for absorbent carrier webs for top layers on laminates by using a mixture consisting of a melamine resin and a water-soluble polymer containing reactive groups in the macromolecule which can react with the melamine resin. This was particularly surprising, because it would have been expected that the necessary resistance to water of the impregnated and compression moulded top layers would suffer as a result of the concomitant use of water-soluble polymers. However, it has been found that the impregnating resins according to the invention, which are stable on storage, are excellently suitable for the production of laminated plastics having an increased resistance to external weathering and for the production of coated chipboards which are particularly elastic and have a high gloss and are, moreover, water-resistant. However, the impregnating resins according to the invention also exhibit advantages for the impregnation of top layers on other laminates, compared with the resins known hitherto.

In the production of decorative laminates for external use it is of course appropriate to employ selected decorative papers which must, in particular, meet the requirements for fastness to light as specified in scale 7–8 of the Textile Standard Specification.

A solution of impregnating resin according to the invention containing 40 to 56% by weight of solid resin which consists to the extent of 80 to 98% by weight of melamine resin and to the extent of 2 to 20% by weight of a water-soluble polymer, is preferentially suitable for the impregnation of the overlay webs and decorative webs for laminated plastics.

A solution of impregnating resin according to the invention containing 45 to 56% by weight of solid resin which consists to the extent of 80 to 98% by weight of melamine resin and to the extent of 2 to 20% by weight of a water-soluble polymer, is preferentially suitable for the impregnation of the webs used for the surface coating of decorative wood materials.

A solution of impregnating resin according to the invention containing 40 to 56% by weight of solid resin which consists to the extent of 80 to 98% by weight of melamine resin and to the extent of 2 to 20% by weight of a water-soluble polymer, is preferentially suitable for the production of thin laminates of high elasticity.

The impregnation of the paper, nonwoven or fabric used for the top layers, with the impregnating resin according to the invention is effected in a known manner in impregnating plants, and the compression moulding of the impregnated and dried top layers is effected by known methods in single-daylight or multi-daylight presses. It can be assumed that —OH, —$CONH_2$ or —CONH—$CH_2OH$ groupings in the water-soluble polymer react with the melamine resin component of the impregnating resin under the conditions of processing.

The examples which follow are intended to illustrate the invention. Examples 1 to 3 relate to the preparation of impregnating resin solutions according to the invention and to their use for the production of laminates for external use. Examples A and B are comparison examples.

EXAMPLE 1

(a) 440 g of 39% strength by weight aqueous formaldehyde solution, 25 ml of water, 3 g of dimethylaminoethanol, 15 g of a 40% strength by weight aqueous solution of sodium aminosulphonate, 35 g of methanol, 25 g of isopropanol and 345 g of melamine are warmed to 90° C. in the course of 40 minutes and stirred at this temperature for 2 hours. This gives a clear resin solution, which has a dilutability ratio with water of 1:2.0. 54 g of water and 54 g of a co-condensation product formed from formaldehyde, formamide and ε-caprolactam in a molar ratio of 5:9:1 are also added to this solution and the mixture is then used for the preparation, described in section (c), of a resin solution according to the invention.

(b) 550 g=700 ml of isopropanol, 250 g=250 ml of tap water, 8 g=5 ml of carbon tetrachloride, 182 g of hydroxyethyl methacrylate, 35 g of acrylamide and 20 g of acrylic acid are put successively into a stock vessel holding 2 l, which is equipped with a stirrer, a gas inlet tube and a bottom outlet, while stirring and passing in a gentle stream of nitrogen; a clear, homogeneous solution of monomers is formed.

A solution of 3.0 g of ammonium persulphate in 50 g=ml of tap water is prepared separately (catalyst solution). The polymerisation vessel used is a glass flask with a capacity of 2 l, equipped with a stirrer, a reflux condenser, a thermometer, a gas inlet tube and 2 inlets for the monomer solution and the catalyst solution. The polymerisation reactor is preheated to a temperature of 78°–80° C. by means of a waterbath. 150 ml of the monomer solution is now run from the stock vessel, via the bottom valve, into the preheated reaction flask. A gentle stream of nitrogen is passed in, while stirring. 5 ml of the catalyst solution are then added in one portion. Polymerisation sets in after approx. 5 minutes, the temperature of the reaction mixture rises to 81°–82° and a gentle reflux is set up. The rest of the monomer solution and the catalyst solution is now metered into the reaction flask at such a rate that a gentle reflux is maintained. The time required for the flow of the monomer solution from the stock vessel into the reactor, after the polymerisation has started, is 1½–2 hours.

The end of the polymerisation reaction manifests itself by the reflux becoming gentler. Stirring is now continued for a further 2 hours, with a gentle reflux, at the same waterbath temperature.

20 g of dimethylaminoethanol are now added and the reflux condenser is replaced by a fractionating column. Distillation is carried out, at a bath temperature of 60°–70° C. and under a waterpump vacuum (20–50 mm), until no more isopropanol passes over. The viscous polymer solution is now diluted with 200 ml of tap water and a further 10 g of dimethylaminoethanol are added in order to adjust the pH to 7.1–8.5.

The end product obtained is a homogeneous, clear, yellowish-brown polymer solution with a solids content of 40%.

(c) 1,000 g of the melamine resin prepared in accordance with section (a) are mixed with 70 g of the copolymer solution prepared in accordance with section (b). (Approx. 5% of solids, calculated on solid melamine resin).

2.8 g of N,N-dimethylethanolamine formate, 0.56 g of a curing agent based on polyphosphoric acid esters and 1.7 g of an impregnating auxiliary based on an oxethylated alkylphenol and also 115 g of water are stirred into this mixture.

This gives approx. 1,190 g of an impregnating solution having a solids content of approx. 50% and a viscosity of 15–20 seconds, determined in accordance with 4 DIN 53,211 at 20° C.

A base paper with a weight per unit area of 80 g/m$^2$ was impregnated in the impregnating resin solution prepared as above, without the inclusion of air, and was dried in the customary manner by treatment with air calculated at temperatures of 130°–160° C. The impregnated paper had a resin content of 60% and a residual moisture content (5 minutes/160° C.) of 5–6%.

The impregnated paper was pressed onto conventional core layers, such as are used for the production of decorative phenolic core laminates, under a moulding pressure of 100 bars, a moulding time of 12 minutes at 140° C. on the object, with subsequent after-cooling to 50° C., to give a high-pressure laminate with a decorative surface of high gloss.

A test carried out on the laminate prepared as described, in a type 1200 QLG Hanau xenotest apparatus resulted in a service life of 3500 hours before reaching a reduction in gloss of approx. 50%, when exposed to weathering in the 17/3 cycle, that is to say 20 minutes of irradiation plus 3 minutes of exposure to rain.

At room temperature, the stability of the combination employed, of melamine resin and acrylate additive without curing agent, was approx. 4 weeks.

A virtually identical result is obtained if, when preparing the solution according to the invention, a melamine-formaldehyde precondensate prepared in accordance with paragraph (aI) is used instead of the precondensate prepared in accordance with paragraph (a), or if the copolymer prepared in accordance with paragraph (b) is replaced by a copolymer prepared in accordance with paragraph (bI).

(aI) 1,435 g of 39% strength by weight aqueous formaldehyde solution, 80 ml of water, 9 g of dimethylaminoethanol, 50 g of a 40% strength by weight aqueous solution of sodium aminosulphonate, 115 g of methanol and 1,132 g of melamine are warmed to 90° C. in the course of 40 minutes and stirred at this temperature for 2 hours. This gives a clear resin solution which has a dilutability ratio with water of 1:2.0. 116 g of water and 175 g of a co-condensation product formed from formaldehyde, formamide and ε-caprolactam in a molar ratio of 5:9:1 are also added to this solution and the mixture can then be employed similarly for the preparation, described in section (c), of a resin solution according to the invention.

(bI) 392 g=500 ml of isopropanol, 150 g=ml of tap water, 4.8 g=3 ml of carbon tetrachloride, 100 g of hydroxyethyl methacrylate, 84 g of methacrylic acid glyceryl ester, 7 g of methacrylic acid, 9 g of glycidol and 2 g of azodiisobutyronitrile are put successively into a stock vessel holding 2 l, which is equipped with a stirrer, a gas inlet tube and a bottom outlet, while stirring and passing in a gentle stream of nitrogen; a clear, homogeneous solution of monomers is formed.

The polymerisation vessel used is a glass flask of 2 l capacity, equipped with a stirrer, a reflux condenser, a thermometer, a gas inlet tube and 1 inlet for the monomer solution. 200 ml of the monomer solution are now run from the stock vessel, via the bottom valve, into the reaction flask. A gentle stream of nitrogen is passed in, while stirring. The polymerisation reactor is heated to a temperature of 78°–80° C. by means of a waterbath. Polymerisation sets in after approx. 5 minutes. The temperature of the reaction mixture rises to 81°–82° and a gentle reflux is set up. The rest of the monomer solution is now metered into the reaction flask at such a rate that a gentle reflux is maintained. The time required for the inflow of the monomer solution from the stock vessel into the reactor, after the polymerisation has started, is 1½–2 hours.

The end of the polymerisation reaction manifests itself by the reflux becoming gentler. Stirring is now continued for a further 2 hours, under a gentle reflux, at the same waterbath temperature.

6 g of dimethylaminoethanol are now added and the reflux condenser is replaced by a fractionation column. Distillation is carried out at a bath temperature of 60°–70° C. and under a waterpump vacuum (20–50 mm) until no more isopropanol passes over. The viscous polymer solution is now diluted with 300 ml of tap water and the pH is adjusted to 7.5–8.0 by adding a further 5 g of dimethylaminoethanol. The end product obtained is a homogeneous, slightly cloudy, yellowish-brown polymer solution with a solids content of 40% which can similarly be employed for the preparation, described in section (c), of a resin solution according to the invention.

EXAMPLE 2

(a) 2,870 g of 39% strength by weight aqueous formaldehyde solution, 160 ml of water, 18 g of dimethylaminoethanol, 100 g of a 40% strength by weight aqueous solution of sodium aminosulphonate, 230 g of methanol, 100 g of isopropanol, 65 g of n-butanol and 2,265 g of melamine are warmed to 90° C. in the course of 40 minutes and stirred at this temperature for 2 hours. This gives a clear resin solution which has a dilutability ratio with water of 1:2.0. 350 g of water and 350 g of a co-condensation product formed from formaldehyde, formamide and ε-caprolactam in a molar ratio of 5:9:1 are also added to this solution and the mixture is then employed for the preparation, described in section (c), of a resin solution according to the invention.

(b) This corresponds to the formulation of Example 1, section b.

(c) 1,000 g of the melamine resin prepared as described in section (a) are mixed with 70 g of the copolymer solution prepared in accordance with Example (1b). This is approx. 5% solids content, calculated on solid melamine resin.

2.8 g of N,N-dimethylethanolamine formate, 0.56 g of a curing agent based on polyphosphoric acid esters, 1.7 g of an impregnating auxiliary based on an oxethylated alkylphenol and 115 g of water are stirred into this mixture.

This gives approx. 1,190 g of an impregnating solution having a solids content of approx. 50% and a viscosity of 14–18 seconds, determined in accordance with 4 DIN 53,211 at 20° C.

Analogously to the instructions in Example 1, section (c), a base paper was impregnated, without inclusion of air, in the impregnating resin solution thus obtained and was dried and compression moulded.

A test carried out in a type 1200 QLG-Hanau xenotest apparatus on the laminate produced resulted in a service life of 3,000 hours before the gloss was reduced to approx. 50% when exposed to weathering in the 17/3 cycle, that is to say 20 minutes irradiation plus 3 minutes exposure to rain.

The stability at room temperature of the combination employed of melamine resin and acrylate additive without curing agent was approx. 3 weeks.

A virtually identical result is obtained if, when preparing the resin solution according to the invention, a melamineformaldehyde precondensate prepared in accordance with paragraph aI is used instead of the precondensate prepared in accordance with paragraph (a), or if the copolymer prepared in accordance with paragraph (b) is replaced by a copolymer prepared in accordance with paragraph bI.

(aI) 45 kg of 39% strength by weight aqueous formaldehyde solution, 16 kg of water, 0.36 kg of dimethylaminoethanol, 2.24 kg of a 40% strength by weight aqueous solution of sodium aminosulphonate, 0.56 kg of diglycol, 1.12 kg of ε-caprolactam and 43 kg of melamine are stirred at 90° C. for 3 hours. This gives a clear resin solution which has a dilutability ratio with water of 1:2.2. 5 kg of a co-condensation product formed from formaldehyde, formamide and ε-caprolactam in a molar ratio of 5:9:1 are also added to this solution and the mixture can then be employed similarly for the preparation, described in section (c), of a resin solution according to the invention.

(bI) 550 g=700 ml of isopropanol, 250 g=ml of tap water, 11.1 g=7 ml of carbon tetrachloride, 200 g of hydroxyethyl methacrylate, 35 g of acrylamide, 20 g of methacrylic acid glyceryl ester and 2.0 g of azodiisobutyronitrile are put successively into a stock vessel holding 2 l, which is equipped with a stirrer, a gas inlet tube and a bottom outlet, while stirring and passing in a slow stream of nitrogen; a clear, homogeneous solution of monomers is formed.

The polymerisation vessel used is a glass flask of 2 l capacity, equipped with a stirrer, a reflux condenser, a thermometer, a gas inlet tube and 1 inlet for the monomer solution. 200 ml of the monomer solution are now run from the stock vessel, via the bottom valve, into the reaction flask. A gentle stream of nitrogen is passed in, while stirring. The polymerisation reactor is heated to a temperature of 78°–80° C. by means of a waterbath. Polymerisation sets in after approx. 5 minutes. The temperature of the reaction mixture rises to 81°–82° and a gentle reflux is set up. The rest of the monomer solution is now metered into the reaction flask at such a rate that a gentle reflux is maintained. The time required for the inflow of the monomer solution from the stock vessel into the reactor, after the polymerisation has started, is 1½–2 hours.

The end of the polymerisation reaction manifests itself by the reflux becoming gentler. Stirring is now continued for a further 2 hours under a gentle reflux and at the same waterbath temperature.

2 g of dimethylaminoethanol are now added and the reflux condenser is replaced by a fractionation column. Distillation is carried out at a bath temperature of 60°–70° C. and under a waterpump vacuum (20–50 mm) until no more isopropanol passes over. The viscous polymer solution is now diluted with 250 ml of tap water and the pH is adjusted to 7.5–8.0 by adding a further 3 g of dimethylaminoethanol. The end product obtained is a homogeneous, slightly cloudy, yellowish-brown polymer solution with a solids content of 40%, which can similarly be employed for the preparation, described in section (c), of a resin solution according to the invention.

EXAMPLE 3

(a) The melamine-formaldehyde precondensate employed is the product prepared in accordance with Example 2, section (a).

(b) 550 g=700 ml of isopropanol, 250 g=ml of tap water, 8 g=5 ml of carbon tetrachloride, 100 g of hydroxyethyl methacrylate, 35 g of acrylamide, 40 g of acrylic acid, 100 g of acrylonitrile and 100 g of acrylic acid methyl ester are put successively into a stock vessel holding 2 l, which is equipped with a stirrer, a gas inlet tube and a bottom outlet, while stirring and passing in a gentle stream of nitrogen; a clear, homogeneous solution of monomers is formed.

A solution of 3.0 g of ammonium persulphate in 50 g=ml of tap water is prepared separately (catalyst solution). The polymerisation vessel used is a glass flask of 2 l capacity, equipped with a stirrer, a reflux condenser, a thermometer, a gas inlet tube and 2 inlets for the monomer solution and the catalyst solution. The polymerisation reactor is preheated to a temperature of 78°–80° C. by means of a waterbath. 150 ml of the monomer solution are now run from the stock vessel, via the bottom valve, into the preheated reaction flask. A gentle stream of nitrogen is passed in, while stirring. 5 ml of the catalyst solution are then added in one portion. Polymerisation sets in after approx. 5 minutes, the temperature of the reaction mixture rises to 81°–82° and a gentle reflux is set up. The rest of the monomer solution and the catalyst solution are now metered into the reaction flask at such a rate that a gentle reflux is maintained. The time required for the inflow of the monomer solution from the stock vessel into the reactor, after the polymerisation has started, is 1½–2 hours.

The end of the polymerisation reaction manifests itself by the reflux becoming gentler. Stirring is now continued for a further 2 hours under a gentle reflux and at the same waterbath temperature.

The mixture is allowed to cool to 50°–60° C., while stirring, and 55.6 g of dimethylaminoethanol are added. The solution should now have a pH of 8.0–8.5.

The end product obtained is a homogeneous, slightly cloudy, yellowish-brown polymer solution with a solids content of 30%, which is filtered through a polyester 105μ sieve.

(c) 1,000 g of the melamine resin prepared in accordance with Example 2, section (a) are mixed with 95 g of the copolymer solution prepared in accordance with paragraph (b) of this example. (This is approx. 5% of solids, calculated on solid melamine resin). 2.8 g of N,N-dimethylethanolamine formate, 0.56 g of a curing agent based on polyphosphoric acid esters and 1.7 g of an impregnating auxiliary based on an oxethylated alkylphenol and also 115 g of water are stirred into this mixture.

This gives approx. 1,190 g of an impregnating solution having a solids content of approx. 50% and a viscosity of 15–20 seconds, determined in accordance with 4 DIN 53,211 at 20° C. Analogously to the instructions in Example 1, section (c), a base paper was impregnated in the impregnating resin solution thus obtained, dried in the customary manner and compression moulded. A test carried out in a type 1200 QLG-Hanau xenotest apparatus on the laminate produced resulted in a service life of 3,500 hours before the gloss was reduced to approx. 50% when exposed to weathering in the 17/3 cycle, that is to say 20 minutes irradiation plus 3 minutes exposure to rain. The stability at room temperature of the combination employed of melamine resin and acrylate additive without curing agent was approx. 2 weeks.

A virtually identical result is obtained if, when preparing the resin solution according to the invention, the copolymer prepared in accordance with paragraph (b) is replaced by a copolymer prepared in accordance with bI.

(bI) 550 g=700 ml of isopropanol, 250 g=ml of tap water, 8 g=5 ml of carbon tetrachloride, 200 g of hydroxyethyl methacrylate, 35 g of acrylamide, 20 g of acrylic acid and 1.3 g of 60% strength tetraallyloxethane are put successively into a stock vessel holding 2 l, which is equipped with a stirrer, a gas inlet tube and a bottom outlet, while stirring and passing in a gentle stream of nitrogen; a clear, homogeneous solution of monomers is formed. A solution of 3.0 g of ammonium persulphate in 50 g=ml of tap water is prepared separately (catalyst solution).

The polymerisation vessel used is a glass flask of 2 l capacity, equipped with a stirrer, a reflux condenser, a thermometer, a gas inlet tube and 2 inlets for the monomer solution and the catalyst solution. The polymerisation reactor is preheated to a temperature of 78°–80° C. by means of a waterbath. 150 ml of the monomer solution are now run from the stock vessel, via the bottom valve, into the preheated reaction flask. A gentle stream of nitrogen is passed in, while stirring. 5 ml of the catalyst solution are then added in one portion. Polymerisation sets in after approx. 5 minutes, the temperature of the reaction mixture rises to 81°–82° and a gentle reflux is set up. The rest of the monomer solution and the catalyst solution are now metered into the reaction flask at such a rate that a gentle reflux is maintained. The time required for the inflow of the monomer solution from the stock vessel into the reactor, after the polymerisation has started, is 1½–2 hours. The end of the polymerisation reaction manifests itself by the reflux becoming gentler. Stirring is now continued for a further 2 hours under a gentle reflux and at the same waterbath temperature.

The mixture is allowed to cool to 50°–60° C., while stirring, and 35 g of dimethylaminoethanol are added. The reflux condenser is now replaced by a fractionation column. Distillation is carried out at a bath temperature of 60°–70° C. and under a waterpump vacuum (20–50 mm) until no more isopropanol passes over. The viscous polymer solution is now diluted with 270 ml of tap water.

The end product obtained is 730 g of a homogeneous, clear, yellowish-brown polymer solution with a solids content of 40%.

COMPARISON EXAMPLE A

A conventional melamine resin which, in accordance with the state of the art, is employed for the production of decorative high-pressure laminates to the requirements of DIN 16,926, was taken, in powder form, for comparison.

500 g of the melamine resin powder are dissolved in 450 g of water and mixed with 1.5 g of an impregnating auxiliary based on an oxethylated alkylphenol.

This gives approx. 950 g of an impregnating liquor having a solids content of approx. 53% and a viscosity of 15–18 seconds, determined in accordance with 4 DIN 53,211 at 20° C.

After curing agents have been added and also after carrying out the procedures identical with those described in Example (1c), the laminate produced, when tested under identical conditions, exhibits a service life of 500 hours before the gloss is reduced to 50% in the xenotest.

The stability at room temperature, in aqueous solution and without curing agent, of the impregnating melamine resin used was approx. 72 hours.

COMPARISON EXAMPLE B 500 g of the melamine resin powder are dissolved in 475 g of water and mixed with 125 g of the polymer solution prepared in accordance with Example (1b) (approx. 10% of solids, calculated on solid melamine resin) and also 1.5 g of an impregnating auxiliary based on an oxethylated alkylphenol.

This gives approx. 1,100 parts by weight of an impregnating solution having a solids content of approx. 50% and a viscosity of 20 seconds, determined in accordance with 4 DIN 53,211 at 20° C.

After the curing agents have been added and after carrying out procedures identical with those described in Example (1c), the laminate produced, when tested under identical conditions, exhibits a service life of 2,000 hours before the gloss is reduced to 50% in the xenotest.

The stability at room temperature of the combination employed of melamine resin and acrylate copolymer without curing agent is approx. 24 hours.

In case the composition or concentration of the impregnating solution is different their viscosity can vary from 14 to 30 seconds determined in accordance with 4 DIN 53,211 at 20° C.

We claim:

1. Low viscosity, aqueous impregnating resin solution with improved stability containing 30–70% by weight of solid resin which comprises:

(A) 80–98% by weight of a melamine-formaldehyde precondensate and (B) 2–20% by weight of a water soluble copolymer, wherein the melamine-formaldehyde precondensate (A) has a molar ratio of melamine:formaldehyde of 1:1.4–2.6 and contains 0.2–1% by weight, relative to solids content, of an amine of the formula

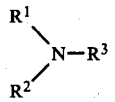

wherein $R^1$ and $R^2$ are identical or different alkyl moieties having 1–4 carbon atoms and $R^3$ is 2-hydroxyethyl, 2-(2-hydroxyethoxy)-ethyl, 3-hydroxy-1-propyl, 3-hydroxy-2-propyl, 2,3-dihydroxypropyl or

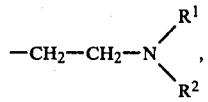

said amine being present wholly or partially in the form of its reaction product with the melamine-formaldehyde precondensate, and wherein said water soluble copolymer (B) is formed from the copolymerization of (a) 0–55% by weight of an ester of acrylic acid, methacrylic acid, crotonic acid, maleic acid or itaconic acid and an alcohol having 1–4 carbon atoms, acrylonitrile, methacrylonitrile or mixtures thereof, (b) 25–100% by weight of a hydroxyethyl or hydroxypropyl ester of at least one acid selected from the group consisting of acrylic acid, methacrylic acid, crotonic acid, maleic acid and itaconic acid; an ester of said acid with glycidol; or mixtures thereof; and (c) 0–25% by weight of at least one member selected from the group consisting of acrylic acid, methacrylic acid, maleic acid, itaconic acid, crotonic acid, acrylamide, methacrylamide, crotonamide and maleic acid half-amide, and wherein said water-soluble polymer is adjusted to a pH-value of 7.1 to 8.5 by means of organic amines of the general formula

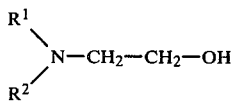

wherein $R^1$ and $R^2$ have the meanings given above.

2. The low viscosity, aqueous impregnating resin solution according to claim 1 wherein the melamine-formaldehyde precondensate additionally contains 0.5–40% by weight, relative to solids content, of an amide modifying agent.

3. The low-viscosity, aqueous impregnating resin solution according to claim 2 wherein the modifying agent is methylenebisformamide, bis-(N-acylaminomethyl) ether of the formula

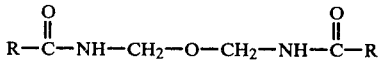

or a condensation product formed from ϵ-caprolactam, formaldehyde and formamide in a molar ratio of 1:a:b; wherein R is H or $-CH_3$ and wherein a is a number from 1 to 20 and b is a number from 1 to 19, with the proviso that a and b are so chosen that the quotient a/(b+1) is 0.5 to 1.

4. The low-viscosity, aqueous impregnating resin solution according to claim 1 or 3 wherein the amine contained in the melamine-formaldehyde precondensate (A) is an amine wherein $R^1$ and $R^2$ are both methyl and $R^3$ is 2-hydroxyethyl or 2,3-dihydroxypropyl.

5. The low-viscosity, aqueous impregnating resin solution according to claim 1 wherein the water-soluble copolymer (B) is a copolymer formed from 0–55% by weight of component (a), 25–80% by weight of component (b) and 2–25% by weight of component (c).

6. Process for the manufacture of a low-viscosity, aqueous impregnating resin with improved stability which comprises mixing (A) 80–98% by weight of a melamine-formaldehyde precondensate and (B) 2–20% by weight of a water soluble copolymer, wherein the melamine-formaldehyde precondensate (A) has a molar ratio of melamine:formaldehyde of 1:1.4–2.6 and contains 0.2–1% by weight, relative to solids content, of an amine of the formula

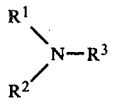

wherein $R^1$ and $R^2$ are identical or different alkyl moieties having 1–4 carbon atoms and $R^3$ is 2-hydroxyethyl, 2-(2-hydroxyethoxy)-ethyl, 3-hydroxy-1-propyl, 3-hydroxy-2-propyl, 2,3-dihydroxypropyl or

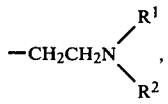

said amine being present wholly or partially in the form of its reaction product with the melamine-formaldehyde precondensate, and wherein said water soluble copolymer (B) is formed from the copolymerization of (a) 0–55% by weight of an ester of acrylic acid, methacrylic acid, crotonic acid, maleic acid or itaconic acid and an alcohol having 1–4 carbon atoms, acrylonitrile, methacrylonitrile or mixtures thereof, (b) 25–100% by weight of a hydroxyethyl or hydroxypropyl ester of at least one acid selected from the group consisting of acrylic acid, methacrylic acid, crotonic acid, maleic acid and itaconic acid; an ester of said acid with glycidol; or mixtures thereof; and (c) 0–25% by weight of at least one member selected from the group consisting of acrylic acid, methacrylic acid, maleic acid, itaconic acid, crotonic acid, acrylamide, methacrylamide, crotonamide and maleic acid half-amide and wherein said water-soluble polymer is adjusted to a pH-value of 7.1 to 8.5 by means of organic amines of the general formula

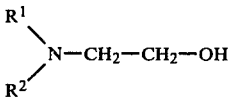

wherein $R^1$ and $R^2$ have the meanings given above.

7. Process according to claim 6 wherein the water-soluble copolymer (B) is mixed in the form of a solution.

8. In the method of producing coated decorative wood materials and laminated sheets with an impregnating resin the improvement comprises the impregnating resin being a solution according to claim 1.

* * * * *